United States Patent [19]

Dalzell et al.

[11] 4,029,314

[45] June 14, 1977

[54] GOLF GAME APPARATUS AND METHOD

[76] Inventors: John J. Dalzell, P.O. Box 316, Walhalla, N. Dak. 58282; James E. Stover, 2250 Dorothy Ave., Boise, Idaho 83706

[22] Filed: Jan. 2, 1976

[21] Appl. No.: 646,090

[52] U.S. Cl. ..... 273/32 R; 273/25; 273/72 R; 273/202

[51] Int. Cl.[2] ..... A63B 57/00

[58] Field of Search ..... 273/25, 26, 26 R, 26 B, 273/26 E, 29 R, 29 A, 32 R, 32 B, 32 D, 32 E, 35 R, 67 R, 72 R, 195 R, 202, 207; 35/29 R, 29 A

[56] References Cited

UNITED STATES PATENTS

| | | | |
|---|---|---|---|
| 1,678,353 | 7/1928 | Reach | 273/32 E |
| 2,147,705 | 2/1939 | Hunter | 273/26 R |
| 2,262,298 | 11/1941 | Procter | 273/32 E X |
| 2,712,939 | 7/1955 | Harp | 273/207 X |
| 2,884,250 | 4/1959 | Patterson | 273/26 E |
| 3,104,876 | 9/1963 | Salsinger | 273/72 R |
| 3,489,411 | 1/1970 | Morelli et al. | 273/26 R |

*Primary Examiner*—William H. Grieb
*Attorney, Agent, or Firm*—Paul F. Horton

[57] ABSTRACT

Golf game apparatus comprising a golf ball, a portable, telescoping stand for supporting the ball at a selected height and a bat having one or more flat hitting surfaces for hitting the ball from the stand in a desired trajectory. The bat may contain a variety of textures and materials for making contact with the ball, and is also adapted for putting. A method for playing the game is included.

1 Claim, 5 Drawing Figures

GOLF GAME APPARATUS AND METHOD

BACKGROUND OF THE INVENTION

1. Field of the Invention

This invention relates to apparatus for playing a golf game and more particularly to apparatus for supporting a golf ball at a selected height and for striking the ball with a selected flat surface at a selected angle. This invention also relates to a method of playing the game with the apparatus. p 2. Description of the Prior Art The two sports of baseball and golf are well-known in our american culture and are among the favorite pastimes. Baseball is a team sport played with a baseball, gloves, and a substantially cylindrical bat. The round shape of the bat imparts a high degree of uncertainty to trajectory. Stands for supporting a baseball for batting practice are well-known and are adapted for level support.

Golf is played with a golf ball and a number of clubs, each having a selected flat hitting surface set at a selected angle to the vertical for controlled lift and placement of the ball. The ball is either hit from its positin on the ground or off a tee which supports the ball approximately one inch off the ground. Thus different types of clubs, different types of supporting the ball, and different methods of swinging at the ball are required for the two sports.

SUMMARY OF THE INVENTION

The present invention comprises gold game apparatus playable on a conventional golf course, including a golf ball, a portable telescoping stand for supporting the ball, a bat having one or more flat hitting surfaces; and a method for using the apparatus.

It is therefore an object of the invention to provide golf game apparatus including a bat having one or more flat hitting surfaces, rotatable in the hands for selecton of a desired hitting angle.

More particularly, it is an object of the invention to provide golf game apparatus including a bat adapted to be swung like a baseball bat.

It is even more particularly, an object to provide a bat adapted to hit a golf ball at a selected angle, the same bat being adapted to be a putter.

It is also an object of the present invention to provide golf game apparatus including a portable, height adjustable golf stand.

More particularly, it is an object to provide a portable, height adjustable stand adapted for hitting a golf ball with a substantially horizontal swing.

It is a further object of the present invention to provide a height adjustable golf ball stand which may be conveniently towed.

Another object is to provide a method for playing golf utilizing a height adjustable stand; a bat having one or more flat hitting surfaces, rotatable in the hands to select a desired hitting angle; and a golf ball.

Additional objects and advantages will become apparent and a more thorough and comprehensive understanding may be had from the following description taken in conjunction with the accompanying drawings forming a part of this specification.

DETAILED DESCRIPTION OF THE INVENTION

Figure 1:
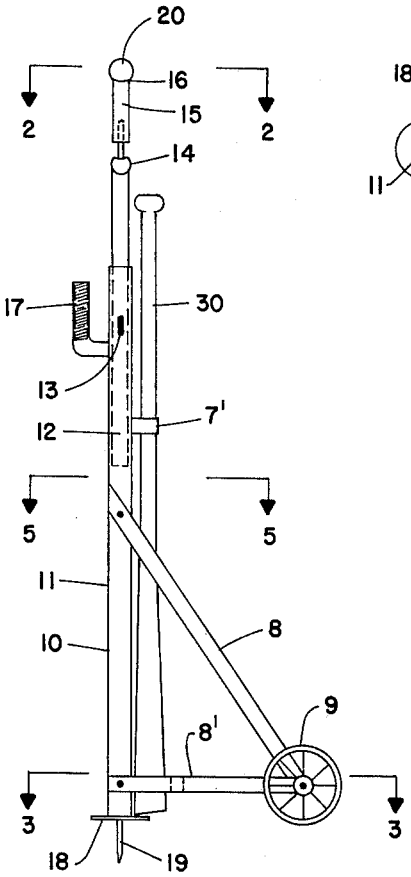
FIG. 1 is a side elevation of the golf ball stand with bat and ball.

Referring now to the drawings, and, more particularly to FIG. 1, the telescoping golf ball stand adapted for use in the present invention is indicated by numeral 10. The stand 10 comprises a substantially tubular frame 11 with a circular base piece 18 attached at its lowermost end. Downwardly depending from base 18 is spike 19 which is adapted to be thrust into the sod by a player stepping on base 18. Positioned above and slidably engaging in a telescopic manner with frame 11 is extensible tube 12. Tube 12 is set and secured at a selected height by set screw 13 which engages tube 12 through a screw hole in frame 11. Attached to the uppermost part of tube 12 is a conventional ball and socket joint 14 with upwardly projecting resilient tube 15 from the ball of said joint. Resilient tube 15 is slightly flanged at its uppermost end to form seat 16 for holding golf ball 20.

Figure 3:
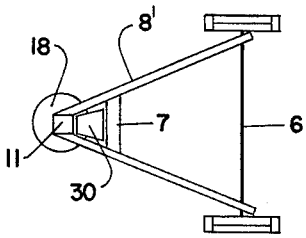
FIG. 3 is a section taken on line 3—3 of FIG. 1.
Figure 4:
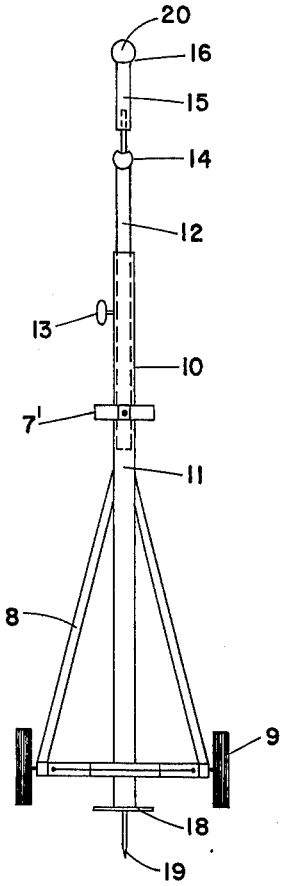
FIG. 4 is a frontal view of the golf ball stand without the bat.

Frame 11 may include means for transporting stand 10 from one location to another. Transporting means may include wheels 9, wheel supporting members 8 and 8' and handle 17. Wheel supporting members 8, as may best be seen in FIG. 1 taken in conjunction with FIG. 3 and FIG. 4 are outwardly an downwardly depending from substantially the vertical midpoint of frame 11. Members 8 extend to a point where they intersect with and engage supporting members 8' which are horizontally disposed and outwardly extending from frame 11. Wheels 9 are rotatably mounted in conventional manner on axle 6 which engages the outermost portions of wheel supporting members 8 and 8'. Handle 17 is an L-shaped tubular member which is welded or otherwise fastened to frame 11 on a side opposite the wheels and at a point near the top of said frame. Handle 17 is used to tow the stand in similar manner as golf carts.

Figure 2:
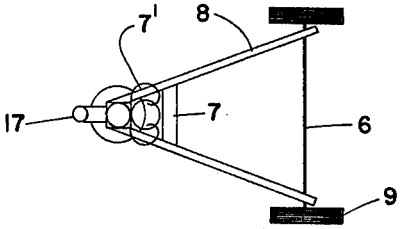
FIG. 2 is a top plan view taken on line 2—2 of FIG. 1.

Frame 11 may also contain bat holding members 7 and 7', as may be seen in FIG. 2 taken in conjunction with FIG. 1. Bat holding member 7' is a crescent shaped band of spring metal in which the ends are curled sharply inward to engage the handle of bat 30 in a clamping manner. Member 7' is attached to frame 11 on the side opposite the handle at a desired height. Bat holding member 7 extends between and attaches to oppositely disposed wheel supporting members 8' so a to conveniently contain bat 30 at its hitting end. Member 7 also gives additional support and strength to wheel supporting members 8'. The stand 10 is preferably made from a lightweight material with aluminum being the preferred material. Resilient tube 15 is preferably made of rubber; bat supporting member 7' from spring steel; and wheels 9 preferably having rubber tires.

Figure 5:
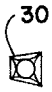
FIG. 5 is a section taken on line 5—5 of FIG. 1 showing the bat only.

The bat adopted for use in the present invention is indicated by numeral 30 in the drawings. Bat 30 comprises a rounded baseball-bat type handle with knob and a ball hitting portion of the bat beginning at substantially the linear midpoint. The preferred embodiment of the bat has a hittin portion that is trapezoidal in shape as may be seen in FIG. 5. The trapezoidal shape gives four flat hitting surfaces, each of which may be knurled or otherwise textured and each of which may contain materials of various striking characteristics. Bats with triangular shaped hitting portions as well as other bats having at least one or moe flat hitting surfaces are within the contemplation of this invention. It is to be noted that the bat 30 may be rotated in the hands so as to present a variety of hitting angles to the golf ball when the bat is swung in a substantially horizontal arc as in conventional baseball. It is also to be noted that the single bat is also useable as a putter. The preferred embodiment of bat 30 includes a body comprised of hard wood. Aluminum and other light metals, or plastics are also satisfactory.

The golf game apparatus of this invention, as described, is useable on any conventional golf course. IN use, spike 19 of portable stand 10 is thrust into the sod by pushing downward upon circular base piece 18 with the heel of the shoe. Seat 16 is then placed at a desired height by loosening set screw 13, moving extensible telescoping tube 12 up or down, and tightening the set screw. Resilient tube 15 is then moved to a substantially vertical position by rotation of the ball of ball and socket joint 14. Golf ball 20 is then placed into seat 16 of stand 10. It is contemplated that the stand 10 may be placed on inclining terrain, yet resilient tube 15 may be moved to a vertical position to correct for the misalignment of the stand. The player then holds bat 30 in baseball fashion and adjusts the hitting angle of the flat hitting surface by rotating the bat in his hands. It will be seen tht if the bat is swung in a horizontal arc that various lifts and distances of the golf ball may be obtained as when using golf clubs with varying angular hitting surfaces. The golf ball 20 is then hit from seat 16 in the desired direction of flight.

After the ball has been hit, bat 30 may be placed on stand 10 and within the confines of bat holding members 7 and 7' and towed by the player to the new position of the ball.

The above described process is then repeated until the ball has reached the putting green. At this point, a selected surface of bat 30 is chosen and the bat is used in substantially the same manner as a golf putter to place the ball in the receptacle.

Having thus described in detail a preferred embodiment and method of using the apparatus of the present invention, it is to be appreciated and will be apparent to those skilled in the art that many physical changes could be made in the apparatus without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein. I claim:

1. Gold game apparatus comprising:

a golf ball;

a portable, extensible, golf ball stand including a base having a downwardly depending spike, a tubular frame vertically mounted on said base, said frame adapted to receive telescopically a proximally located tube, a proximally located extensible tube telescopically engaging said tubular frame, said extensible tube containing at its uppermost end a socket for receiving a ball, a resilient tube containing a ball at its lowermost end for mating with the socket of said extensible tube and containing a seat at its uppermost end for supporting said golf ball, and a pair of axially aligned wheels divergently attached to a lower portion of said frame adjacent said base; and a bat having four planar striking surfaces parallel to the longitudinal axis of said bat and having a trapezoidal cross section across the striking surfaces, said bat adapted for rotation in the hands.

* * * * *

UNITED STATES PATENT OFFICE

CERTIFICATE OF CORRECTION

Patent No. 4,029,314 Dated June 14, 1977

Inventor(s) Dalzell et al.

It is certified that error appears in the above-identified patent and that said Letters Patent are hereby corrected as shown below:

Column 1, line 32: The word "gold" should read golf

Column 3, line 31: The word "tht" should read that

Column 4, line 19: The word "Gold" should read Golf

Signed and Sealed this

Fourth Day of October 1977

[SEAL]

*Attest:*

RUTH C. MASON
*Attesting Officer*

LUTRELLE F. PARKER
*Acting Commissioner of Patents and Trademarks*